United States Patent [19]

Horio

[11] Patent Number: 4,825,470

[45] Date of Patent: May 2, 1989

[54] INDUSTRIAL DIGIT GLOVE AND FABRIC MANUFACTURING PROCESS

[76] Inventor: Yoshihito Horio, 193, Huruwatari, Kochino-cho, Konan-shi, Aichi-ken, Japan, 483

[21] Appl. No.: 106,396

[22] Filed: Oct. 9, 1987

[30] Foreign Application Priority Data

Apr. 10, 1987 [JP] Japan ..... 62-89312

[51] Int. Cl.[4] ..... A41D 13/08

[52] U.S. Cl. ..... 2/21; 2/163; 2/167; 2/161 R; 2/169

[58] Field of Search ..... 2/21, 161 R, 163, 168, 2/169, 167, 161 A, 159, 16

[56] References Cited

U.S. PATENT DOCUMENTS

| | | | |
|---|---|---|---|
| 1,642,311 | 9/1927 | Richardson | 2/163 X |
| 3,263,682 | 8/1966 | Rosenfield | 2/21 X |
| 4,470,251 | 9/1984 | Bettcher | 2/161 R |
| 4,733,410 | 3/1988 | Glotkin | 2/21 |

FOREIGN PATENT DOCUMENTS 60-2703 of 1984 Japan .

*Primary Examiner*—Peter Nerbun

*Attorney, Agent, or Firm*—Burns, Doane, Swecker & Mathis

[57] ABSTRACT

The present invention discloses an industrial digit glove comprising a hollow tubular-shaped body knitted from a high-tenacity fiber of aramid and nylon yarn wound so as to cover a core of stainless steel wire and spun aramid fiber yarn, and a digit-gripping section at the open end of said holow tubular-shaped body which is rubber-impregnated to prevent the glove from loosening from the finger. This industrial digit glove is manufactured by means of a first process whereby a hollow tubular-shaped body of the required length is knitted using a high-tenacity fiber formed by winding aramid fiber yarn and nylon yarn around a core of stainless steel wire and spun aramid fiber yarn, a second process whereby the curled open end of said hollow tubular-shaped body knitted in the first process is impregnated with fluid rubber, and a third process whereby the hollow tubular-shaped body obtained in the completed second process is hot-air dried. The industrial digit glove of the present invention is preferably manufactured by means of incorporating a fourth process whereby the curled open-ended portion of the tubular-shaped body obtained in the completed third process is removed by cutting and said open end is again impregnated with fluid rubber and hot-air dried.

8 Claims, 3 Drawing Sheets

INDUSTRIAL DIGIT GLOVE AND FABRIC MANUFACTURING PROCESS

BACKGROUND OF THE INVENTION

The present invention relates to an industrial digit glove which protects fingers from cutting tools, splinters, steel billets, pieces of glass, and the like while performing every type of factory work and/or metal working in schools in addition to other miscellaneous work.

DESCRIPTION OF THE PRIOR ART

A knitted glove of high-tenacity fiber formed by winding a covering of one or more twisted fibers over a core of stainless steel wire and aramid fiber as disclosed in Tokkai No. Sho 60-2703 is well known by those skilled in the art. Stainless steel wire and aramid fiber are costly, however, and since a large quantity of the aforesaid high-tenacity fiber is required in the case of a glove to protect the fingers, palm and back of the hand in total, the incurred cost is unavoidably high. In comparatively light work which does not involve the use of large tools, injury from cutting tools and the like is most likely to occur to the fingers with injury to the palm or back of the hand being extremely rare.

SUMMARY OF THE INVENTION

An object of the present invention is to provide an economical industrial digit glove which can effectively prevent injury to fingers.

Another object of the present invention is to provide an industrial digit glove which will reside securely on the finger and be resistant to inadvertent removal.

A further object of the invention is to provide a manufacturing process whereby a digit glove of superior workmanship can be produced.

An industrial digit glove of the present invention which accomplishes the aforesaid objects comprises a hollow tubular-shaped body knitted from a high-tenacity fiber of aramid and nylon yarn wound so as to cover a core of stainless steel and spun aramid fiber yarn, and a digit-gripping section at the open end of said hollow tubular-shaped body which is rubber-impregnated to prevent the glove from loosening from the finger.

Furthermore, a manufacturing process for the industrial digit glove of the present invention comprises a first process whereby a hollow tubular-shaped body of the required length is knitted using a high-tenacity fiber formed by winding aramid fiber yarn and nylon yarn around a core of stainless steel wire and spun aramid fiber yarn, a second process for rubber-impregnation whereby the curled open end of said hollow tubular-shaped body knitted in the first process is impregnated with fluid rubber, and a third process whereby the hollow tubular-shaped body obtained in the completed second process is hot-air dried.

A modified embodiment of the manufacturing process for the present invention comprises a fourth process whereby the curled open-ended portion of the tubular-shaped body obtained in the completed third process is removed by cutting and said open end is again impregnated with fluid rubber and hot-air dried.

The high-tenacity fiber provided by the present invention has stainless steel wire and spun aramid fiber yarn as a core, said core being covered by a wound aramid fiber yarn and nylon yarn. The high-tenacity fiber of the present invention comprises a single strand of spun aramid fiber yarn 2 disposed along a single strand of stainless steel wire 1 to form a core around which is wound a covering of aramid fiber yarn 3 in, for example, a right-hand winding, and which is in turn covered by a nylon yarn 4 wound in a left-hand winding, said high-tenacity fiber being preferably of the construction shown in FIG. 7. Ideally, the stainless steel wire 1 will be a 0.04 mm diameter ultra-fine WPS stainless steel wire which can ensure the sectility resistance against sharp cutting tools such as razors and the like. High-tenacity fiber 5 is easily cuttable by a cutting tool if only spun aramid fiber yarn 2 is employed as a core without the incorporation of stainless steel wire 1, yet said high-tenacity fiber 5 cannot be cut by said cutting tools when stainless steel wire 1 is incorporated into the core. The optimum applicable diameter for the stainless steel wire 1 is 0.04 mm since larger diameter wires of 1.5 to 2.5 mm are inappropriate for braiding into the digit glove form, and smaller diameter wires have reduced sectility resistance. The diameter of the stainless steel wire 1 is not limited, however, to 0.04 mm. To have the appropriate degree of suppleness and sectility resistance for the knitted digit glove, the double-strand spun Kebular fiber yarn 2.0 (proprietary name) is most desirable for use as the spun aramid fiber yarn 2, said spun yarn having a thickness of approximately 531.6 denier. The single-strand spun Kebular fiber yarn 2.0 having a thickness of approximately 265.8 deniers may also be used for the spun aramid fiber yarn 2. In addition, superior results also have been obtained using double-strand spun Kebular fiber 3.0 having a thickness of about 354.2 deniers, single-strand spun Kebular fiber 3.0 having a thickness of about 177.1 deniers, double-strand spun Kebular fiber 4.0 having a thickness of about 266 deniers, and single-strand spun Kebular fiber 4.0 of approximately 133 deniers.

The aramid fiber yarn 3 is ideally a 200 denier Kebular Filament (proprietary name). Aramid fiber yarn 3 is wound, for example, in a right-hand winding by a covering machine so as to cover the core formed by stainless steel wire 1 and spun aramid fiber yarn 2. Nylon yarn 4 which is preferably a thickness of 80 to 120 deniers is wound, for example, in a left-hand winding by a covering machine so as to cover said aramid fiber yarn 2 and to prevent it unraveling.

The digit glove of the present invention comprises a hollow tubular-shaped body knitted by a digit glove knitting machine utilizing a high-tenacity fiber 5 as the basic material, and a digit-gripping section at the open end of said hollow tubular-shaped body which is rubber-impregnated to prevent the glove from loosening from the finger. Because the high-tenacity fiber 5 has a stainless steel wire 1 incorporated therein, finish overlocking using an overlock machine is difficult due to the open end at the base of the knitted digit glove which is curled outwardly via the bending stress applied to said stainless steel wire 1 when it is discharged after passing through the digit glove knitting machine. Raw or synthetic rubber is fixed to the open end of the digit glove to prevent loosening of fibers because the fibers of the glove loosen from the open end if said open end of the glove is not overlocked. Since the rubber has great elasticity, the open end of the digit glove does not harden and the finger can be easily inserted therein.

An explanation of the manufacturing process for the digit glove of the present invention follows hereinafter with reference to FIGS. 1 to 3.

In the first process, a high-tenacity fiber 5 as shown in FIG. 7 is supplied to a digit glove knitting machine and a knitted digit glove 6 is produced, for example, 5 mm to 1 cm longer than the required length as shown in FIGS. 1 and 2. The open end 7 of the digit glove bends as it is fed during discharge from the knitting machine, i.e., the open end 7 curls outwardly via the bending stress applied to the stainless steel wire 1 which forms the core of the high-tenacity fiber 5.

In the second process, the open end 7 of the digit glove 6 is impregnated with fluid rubber such as a natural latex, for example. By means of this impregnation, the open end 7 of digit glove 6 is covered on interior and exterior surfaces by a rubber layer as shown in FIGS. 1 and 2.

In the third process, the digit glove 6 is hot-air dried and rubber layer 8 is solidified.

DETAILED DESCRIPTION OF THE PREFERRED EMBODIMENTS

(Example 1)

Figure 1:
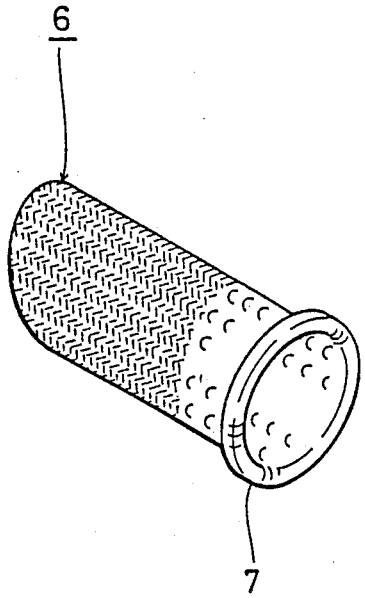
FIG. 1 is a perspective illustration to explain the manufacturing process for the digit glove related to the present invention.
Figure 2:
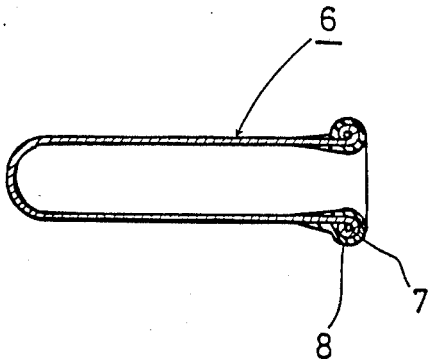
FIG. 2 is a cross-sectional view of FIG. 1.
Figure 7:
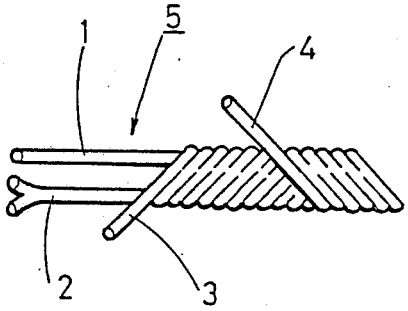
FIG. 7 is a perspective illustration showing the preferred construction of the high-tenacity fiber.

Using only a single strand of the high-tenacity fiber 5 described by the aforesaid preferred construction and FIG. 7, a digit glove 6 knitted by a digit glove knitting machine in the manner described in FIGS. 1 and 2 can be obtained, said glove having a thin and soft finished texture. A digit glove 6 can be knitted approximately 5 mm to 1 cm in excess of the required finished length. The open end 7 of digit glove 6 is impregnated with a fluid rubber such as a natural latex for approximately 1 cm of its length, the fluid rubber then being dried continuously for about 2 to 3 minutes by hot air at a temperature of 80° to 90° C., and resulting in the manufacture of a digit glove having a curled open end.

(Example 2)

Figure 3:
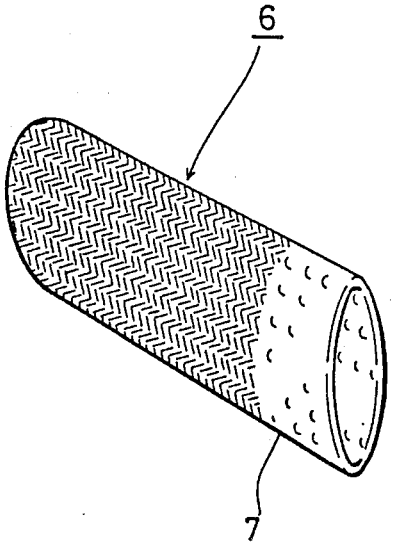
FIGS. 3 to 5 are perspective illustrations showing other modifications to the digit glove of the present invention.

Approximately 5 mm of the curled portion of the digit glove obtained in Example 1 is cut off resulting in a digit glove without a curl as shown in FIG. 3, then the open end is again impregnated with a natural latex for a length of about 1 to 2 cm whereupon it is hot-air dried in an identical manner to Example 1. According to Example 2, a digit glove 6 is manufactured which has a digit-gripping open end 7 to prevent loosening of the glove on the finger and which is not provided with a curled section on open end 7 as shown in FIG. 3.

(Example 3)

Figure 4:
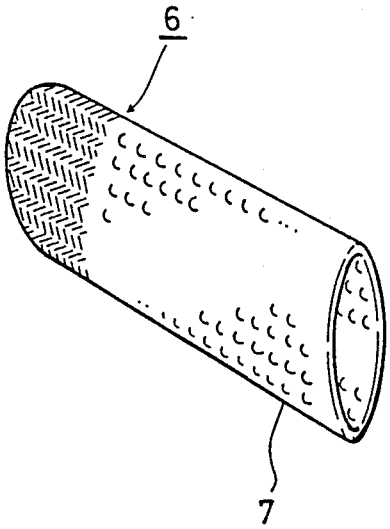

A digit glove obtained in Example 3 is produced via a manufacturing process substantially similar to that of Example 2 with the only modification being that the digit-gripping rubber layer is lengthened, as shown in FIG. 4. In Example 3 a colored digit glove may be manufactured by the mixing of pigments in the fluid rubber.

(Example 4)

Figure 5:
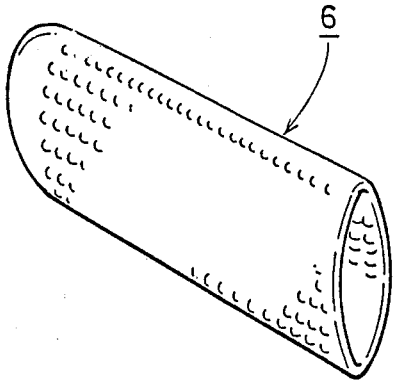
Figure 6:
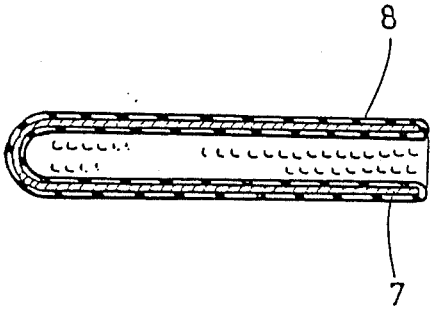
FIG. 6 is a cross-sectional view of FIG. 56.

The digit glove of Example 4, shown in FIGS. 5 and 6, is produced in substantially the same manner as that of Example 3 with the only modification being that the entire length of digit glove 6 is covered by a rubber layer 8. A colored digit glove can be manufactured by mixing pigment in the fluid rubber which forms the rubber layer 8; coloring tints may be, for example, red, yellow, green, and the like. Additionally, because the digit glove of Example 4 is completely covered over its entire length by a rubber layer 8, it may also be used as a water-proof digit glove.

(Example 5)

A digit glove may also be knitted using a base material of dual strands of high-tenacity fiber 5 of a construction as shown in FIG. 7. Furthermore, the digit glove may be composed of a base material of a single strand of high-tenacity fiber 5 and a single strand of double-stranded spun Kebular yarn 2.0, depending on the service to which it is to be put by the wearer.

(Example 6)

A colored digit glove can be manufactured by using colored nylon yarn for the nylon yard 4 shown in FIG. 7. Digit gloves of various colors such as red, yellow, green, and the like, can be provided because nylon yarn readily accepts dye.

What is claimed is:

1. An industrial digit glove comprising:

a hollow tubular-shaped body having a closed end and an open end, said hollow tubular-shaped body being knitted from at least one strand of high-tenacity fiber, the open end of the hollow tubular-shaped body being rubber impregnated to allow easy insertion of a finger into the digit glove and to prevent loosening of the high-tenacity fiber, said high-tenacity fiber including a core and two wrappings wound around the core, said core including one stainless steel wire having a diameter of about 0.04 mm and one spun aramid fiber yarn adjacent said one stainless steel wire, said one spun aramid fiber yarn having a thickness of about 133 deniers to about 531.6 deniers, said two wrappings including a first wrapping of aramid fiber yarn that is wound around the core in a first direction and a second wrapping of nylon yarn that is wound around the first wrapping in an opposite direction, said nylon yarn having a thickness of about 80 deniers to about 120 deniers.

2. An industrial digit glove in accordance with claim 1, wherein dual strands of said high-tenacity fiber are utilized for knitting the hollow tubular-shaped body.

3. An industrial digit glove in accordance with claim 1, wherein a single strand of said high-tenacity fiber and a single strand of spun aramid fiber yarn disposed along said single strand of high-tenacity fiber and having a thickness of about 531.6 deniers are used for knitting the glove.

4. An industrial digit glove in accordance with claim 1, wherein substantially the entire length of the hollow tubular-shaped body is covered with a rubber layer.

5. An industrial digit glove in accordance with claim 4, wherein said rubber layer has pigment mixed therein for coloring the digit glove.

6. An industrial digit glove in accordance with claim 1, wherein said nylon yarn is a colored nylon yarn.

7. A method of manufacturing an industrial digit glove having a finished length comprising the steps of:

knitting with a knitting machine a hollow tubular-shaped body that is longer than the finished length of the digit glove from at least one high-tenacity fiber having a core comprised of one stainless steel wire whose diameter is approximately 0.04 mm and one spun aramid fiber yarn, and two wrappings wrapped around said core, one of said wrappings being an aramid fiber yarn wound around the core in a first direction and the other wrapping being a nylon yarn that is wound around the one wrapping in an opposite direction, said hollow tubular-shaped body having a closed end and an open end and the open end of said hollow tubular-shaped body being curled outward as a result of the bending stress applied to the stainless steel wire by the knitting machine during the knitting step;

impregnating the curled open end of the hollow tubular-shaped body with fluid rubber; and hot-air drying the hollow tubular-shaped body to dry the fluid rubber.

8. A method of manufacturing an industrial digit glove having a finished length comprising the steps of:

knitting with a knitting machine a hollow tubular-shaped body that is longer than the finished length of the digit glove from at least one high-tenacity fiber having a core comprised of one stainless steel wire whose diameter is approximately 0.04 mm and one spun aramid fiber yarn, and two wrappings wrapped around said core, one of said wrappings being an aramid fiber yarn wound around the core in a first direction and the other wrapping being a nylon yarn that is wound around the one wrapping in an opposite direction, said hollow tubular-shaped body having a closed end and an open end and the open end of said hollow tubular-shaped body being curled outward as a result of the bending stress applied to the stainless steel wire by the knitting machine during the knitting step;

impregnating the curled open end of the hollow tubular-shaped body with fluid rubber;

hot-air drying the hollow tubular-shaped body to dry the fluid rubber;

removing the curled open end of said hollow tubular-shaped body;

impregnating the open end of the hollow tubular-shaped body with fluid rubber; and hot air-drying the hollow tubular-shaped body to thereby prevent loosening of the at least one high-tenacity fiber.

* * * * *